US009361812B2

(12) United States Patent
Blume

(10) Patent No.: US 9,361,812 B2
(45) Date of Patent: Jun. 7, 2016

(54) MODULAR STORAGE COMPONENT

(71) Applicant: ACCO Brands Corporation, Lake Zurich, IL (US)

(72) Inventor: Megan B. Blume, Springboro, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 12 days.

(21) Appl. No.: 14/226,277

(22) Filed: Mar. 26, 2014

(65) Prior Publication Data

US 2014/0290107 A1 Oct. 2, 2014

Related U.S. Application Data

(60) Provisional application No. 61/805,329, filed on Mar. 26, 2013.

(51) Int. Cl.

| | |
|---|---|
| ***G09F 3/08*** | (2006.01) |
| ***G09F 3/04*** | (2006.01) |
| ***G09F 7/18*** | (2006.01) |

(52) U.S. Cl.

CPC .. *G09F 3/04* (2013.01); *G09F 7/18* (2013.01); *Y10T 29/49826* (2015.01)

(58) Field of Classification Search

CPC ..... G09F 3/04; G09F 3/14; G09F 3/10; G09F 3/0288; G09F 3/02

USPC ..... 40/673

See application file for complete search history.

(56) References Cited

U.S. PATENT DOCUMENTS 373,235 A * 11/1887 Isbell ..... 40/107
2,743,011 A * 4/1956 Woofter ..... 206/488
2,965,978 A * 12/1960 Olson ..... 434/238
3,146,937 A 9/1964 Vesak
3,367,491 A 2/1968 Dunham et al.
4,133,123 A * 1/1979 Anderson ..... 40/1
4,213,559 A * 7/1980 Meyers ..... 229/117.18
4,319,531 A * 3/1982 Caldwell ..... 108/152
4,531,313 A * 7/1985 Fast ..... 40/657
4,632,242 A * 12/1986 Choi et al. ..... 206/45.24
4,687,094 A 8/1987 Allsop et al.
4,694,596 A * 9/1987 Fast ..... 40/663

(Continued)

OTHER PUBLICATIONS

Webpage featuring "1-3/4" x 1-1/2" Merchandise Display Tabs" by BrownCor, http://www.browncor.com/product/B61012.htm?utm_source=googleps&utm_medium=GPS&utm_campaign=GMerchants (retrieved from the internet on Jun. 11, 2012).

(Continued)

*Primary Examiner* — Shin Kim
(74) *Attorney, Agent, or Firm* — Thompson Hine LLP

(57) ABSTRACT

A system including a first component configured to be attached to a vertical surface, the first component including at least a pair of protrusions coupled thereto with a spacing therebetween. The system further includes a second component including a pair of hang tags coupled thereto. Each hang tag has an opening therethrough with a spacing therebetween. The spacing between the openings of said hang tags generally corresponds to the spacing between the pair of protrusions such that each protrusion is receivable through the opening of an associated one of the hang tags to removably couple the second component to the first component. Each hang tag is generally flat and planar and is movable in a direction generally parallel to a plane of the associated hang tag.

30 Claims, 3 Drawing Sheets

(56) References Cited

U.S. PATENT DOCUMENTS

| | | | | | |
|---|---|---|---|---|---|
| 4,754,563 | A | * | 7/1988 | Fast | 40/663 |
| 4,993,583 | A | * | 2/1991 | Chasen | 220/482 |
| D331,855 | S | * | 12/1992 | Kaplan | D6/512 |
| D370,936 | S | * | 6/1996 | Hofman et al. | D19/52 |
| D377,948 | S | * | 2/1997 | Pruhs | D19/52 |
| 5,658,635 | A | * | 8/1997 | Davis et al. | 428/81 |
| 5,833,077 | A | * | 11/1998 | Engel | 211/59.1 |
| 5,941,623 | A | * | 8/1999 | Linehan | 312/404 |
| 5,955,170 | A | * | 9/1999 | Davis et al. | 428/81 |
| 6,209,778 | B1 | | 4/2001 | Henrikson et al. | |
| 7,428,972 | B2 | * | 9/2008 | Warner et al. | 211/59.1 |
| 7,628,426 | B1 | | 12/2009 | Rowe et al. | |
| 7,819,432 | B2 | | 10/2010 | Rowe et al. | |
| 8,839,964 | B2 | * | 9/2014 | Hawkins | 211/87.01 |
| 2003/0015149 | A1 | * | 1/2003 | Krey et al. | 119/858 |
| 2006/0086014 | A1 | * | 4/2006 | Plank et al. | 40/124.06 |
| 2009/0236843 | A1 | | 9/2009 | Rowe et al. | |

OTHER PUBLICATIONS

Webpage featuring "Black Bulletin Board With Hooks" by Poverty Barn WoodWorks, http://www.etsv.com/listing/91769062/black-bulletin-board-with-hooks?utm_medium=syndication&utm_campaign=GPS (retrieved from the internet on Jun. 11, 2012).

* cited by examiner

MODULAR STORAGE COMPONENT

This Application claims priority to U.S. Provisional Patent Application Ser. No. 61/805,329, filed on Mar. 26, 2013, the entire contents of which are hereby incorporated by reference.

The present invention is directed to a storage system, and more particularly, to a storage system utilizing a component with retractable hang tags.

BACKGROUND

Storage space is often limited in home and office environments, leading to clutter and lack of organization. Offices and homes typically include vertical surfaces, such as walls, cubicle dividers, etc. which can be under-utilized from a storage perspective.

SUMMARY

The present invention is a system which can enable greater usage of such vertical surfaces. In particular, in one embodiment the invention is a system including a first component configured to be attached to a vertical surface, the first component including at least a pair of protrusions coupled thereto with a spacing therebetween. The system further includes a second component including a pair of hang tags coupled thereto. Each hang tag has an opening therethrough with a spacing therebetween. The spacing between the openings of said hang tags generally corresponds to the spacing between the pair of protrusions such that each protrusion is receivable through the opening of an associated one of the hang tags to removably couple the second component to the first component. Each hang tag is generally flat and planar and is movable in a direction generally parallel to a plane of the associated hang tag.

DETAILED DESCRIPTION

Figure 1:
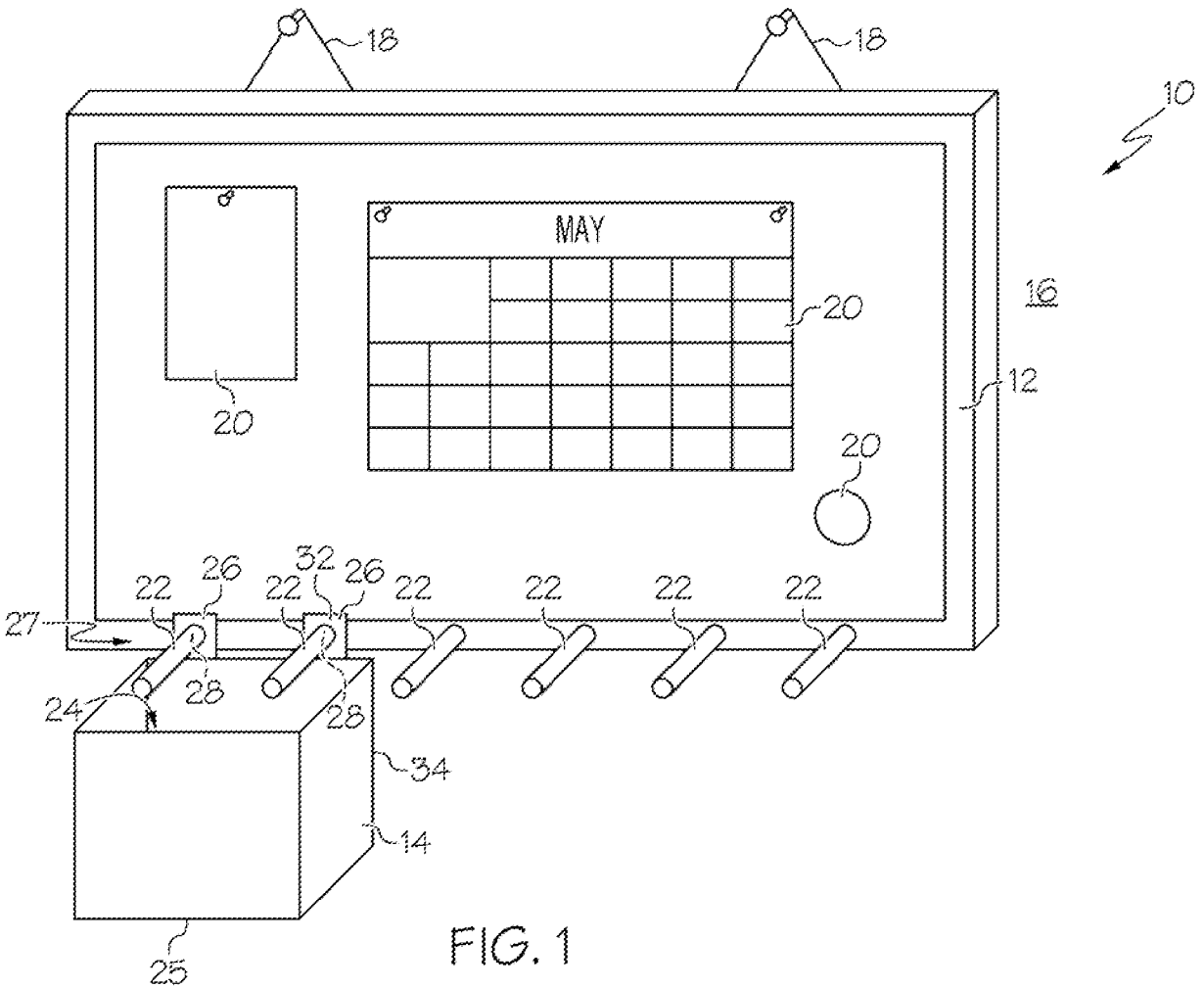
FIG. 1 is a front perspective view of one embodiment of the system of the present invention.

With reference to FIG. 1, the system 10 of the present invention may include a first component, or board 12, and a second component, or storage component 14. The board 12 can take any of a wide variety of forms, such as a generally flat, planar component which is configured to be attached to a vertical surface 16 such as a wall, cubicle divider, side of a bookshelf, etc. The board 12 can include or be coupled to a pair of wires 18, secured to its rear surface in the illustrated embodiment, to facilitate hanging the board 12 from the vertical surface 16. The board 12 can also or instead include openings configured to receive nails/screws therein, hooks from which the board 12 can be suspended, a ledge from which the board 12 can be suspended, and various other mounting arrangements. Moreover, in some cases the board 12, as manufactured and/or sold, may not be specifically configured for hanging, but may be configured to be attached to the vertical surface 16 by its shape and/or materials alone (i.e. be capable of receiving or being coupled to wires, screws, nails, adhesive components, etc.).

The board 12 can take any of a variety of forms, including a corkboard or bulletin board to which various components 20 can be attached. However, the board 12 can also be any of a variety of other various forms, including a white board including a high-gloss surface which can be written upon by dry-erase markers, wherein the markings can be removed by wiping. The board 12 may also take the form a blackboard which can be written upon by chalk, or a felt board, bulletin board, calendar, display board, support board or panel, etc. or other component configured to display information, accommodate papers and the like. Moreover, it should be understood that the board can include more than one of these functionalities (e.g. corkboard, white board, black board, felt board) combined into a single board or component.

The board 12 may include a plurality of protrusions 22 extending generally forwardly/outwardly from a plane of the board 12, or forwardly/outwardly from the vertical surface 16. In the illustrated embodiment, the protrusions 22 take the form of horizontally aligned, cylindrical/tubular pegs, although the protrusions 22 can take any of a variety of other forms, including hooks, catches, hangers, clasps, brackets, etc. In the illustrated embodiment, the protrusions 22 extend along the bottom edge of the board 12, and each protrusion 22 is equally spaced from any adjacent protrusion 22. In one embodiment, the protrusions 22 are permanently and non-removably coupled to the board 12, although the protrusions 22 can be removably coupled to the board 12. Moreover, the protrusions 22 may be located at various location of the board 12, besides the bottom edge. In the illustrated embodiment six protrusions 22 are utilized. However, any desired number of protrusions 22 can be utilized, including at least four protrusions 22 in one case to allow various mounting arrangements as will be evident based upon the disclosure below.

Figure 2:
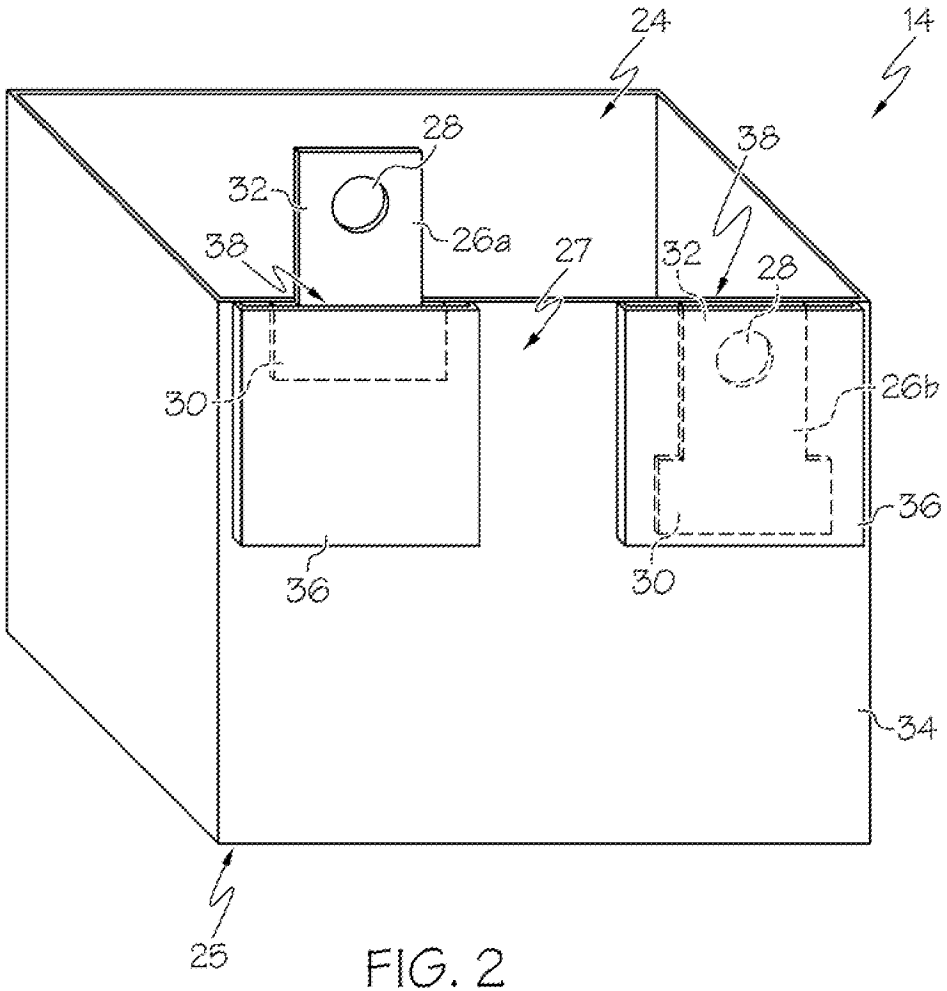
FIG. 2 is a rear perspective view of the storage component of the system of FIG. 1, with one of the hang tags in an extended position and the other hang tag in its refracted position.

The storage component 14 can take any of a wide variety of forms, but in one embodiment is a generally rectangular prism defining an inner space, cavity or volume 24 therein. In one embodiment the storage component 14 has a generally flat bottom 25 such that the storage component 14 can be stably positioned on a horizontal surface and used separate and apart from the board, as shown in FIG. 2.

The storage component 14 can include a hang tag assembly, generally designated 27, coupled thereto, which can include one or more hang tags 26. Each hang tag 26 can include or take the form of a generally flat, planar piece of material having an opening 28 formed therethrough. In one embodiment, each hang tag 26 has a generally inverted "T" shape including a crossbar 30 and a central base 32, and the opening 28 is positioned in the base 32, at the distal end thereof in one case.

Each hang tag 26 may be slidably/movably mounted to the storage component 14. In particular, with reference to FIG. 2, each hang tag 26 can be movable between an extended/deployed position (hang tag 26*a*), wherein the hang tag 26 generally protrudes generally outwardly (upwardly) from the storage component 14, and a retracted/undeployed position (hang tag 26*b*), wherein the hang tag 26 does not protrude generally outwardly from the storage component 14, and is generally positioned within the height dimension of the storage component 14 (or at least protrudes less compared to when the hang tag 26 is in the extended position). When in the extended position, the opening 28 of the hang tag 26 is accessible and can receive a protrusion 22 therethrough. In contrast, when in the retracted position the opening 28 is blocked by the body of the storage component 14, and is not accessible and cannot receive a protrusion 22 therethrough.

The component 14/hang tag assembly 27 can include one or more tabs 36 coupled to a rear panel 34 of the storage component, wherein each tab 36 traps a hang tag 26 between the rear panel 34 and the tab 36. Each tab 36 can be coupled to the rear panel 34 about generally the entire perimeter thereof, except for at least part of a top edge, defining a slot area 38 through which the base 32 of a tag protrudes. Alternatively, the slot area 38 can be formed in the body of the tab 36 and/or the rear panel 34.

The slot area 38 can have a width longer than the width of the base 32 of the associated tag 26, and shorter than the width of the crossbar 30. In this manner, when the tag 26 is moved to its extended position, the crossbar 30 of the tag 26 engages the tab 36 and prevents further extraction of the tag 26, preventing the tag 26 from being separated from the storage component 14. In this manner, each hang tag 26 can slide, within the tab 36, between its extended and retracted position.

The coupling arrangement illustrated in FIG. 2 ensures that the hang tags 26 are positioned externally of the inner cavity 24 of the storage component 14, to avoid interference with any components to be stored therein. However, it should be understood that FIG. 2 merely illustrates one embodiment by which the hang tags 26 can be slidably coupled to the storage component 14, and any of a wide variety of coupling arrangements can be utilized. In the illustrated embodiment, the hang tags 26 are generally co-planar in a plane which is generally parallel to a plane of the board 12 and/or the plane of the vertical surface 16. Moreover, in the illustrated embodiment both hang tags 26 are coupled to the same side (e.g. the back side, in the illustrated embodiment) of the storage component 14, but these configurations could be varied as desired.

The hang tag assembly 27 can be configured such that the horizontal spacing between the openings 28 of each hang tag 26 generally corresponds to the horizontal spacing of the protrusions 22. In this case, a protrusion 22 can be received through each associated opening 28 to removably couple/hang the storage component 14 from the board 12, when the hang tags 26 are in their extended positions, as shown in FIG. 1.

In the illustrated embodiment, the hang tags 26 are configured to receive adjacent protrusions 22 therethrough. However, the hang tags 26 and/or protrusions 22 can be configured such that the hang tags 26 receive non-adjacent protrusions 22 therethrough (i.e. a protrusion 22 can be positioned between the protrusions 22 from which the storage component 14 hangs). Further alternately, the storage component 14 can include more or less than two hang tags 26, each being configured and positioned to receive a protrusion 22. Even further alternately, the storage component 14 can include a single hang tag 26 with multiple openings 28, or with a single opening large enough to receive multiple protrusions 22 therethrough.

Thus, it can be seen that each hang tag 26 can be moved to its extended position to enable the associated storage component 14 to be suspended from the board 12. This configuration enables the storage component 14 to be hung from the board 12, and thereby to a vertical surface 16 to make use of vertical storage space. The storage component 14 can also be used in conjunction with the board 12. For example, the board 12 can include certain reminders written or carried thereon (e.g. a written reminder to bring a set of keys) and the associated item (e.g. the car keys) can be stored in the component 14 coupled to the board 12. Thus the storage component 14 and board 12 can be used cooperatively. In addition, as noted above the storage component 14 may also be configured to be used as a stand-alone device separate and apart from the board 12. In this case, the hang tags 26 can be moved to their retracted position (for ease of access to the inner cavity 24) and the storage component 14 placed on a desk or the like for stand-alone use, as shown in FIG. 2.

Figure 3:
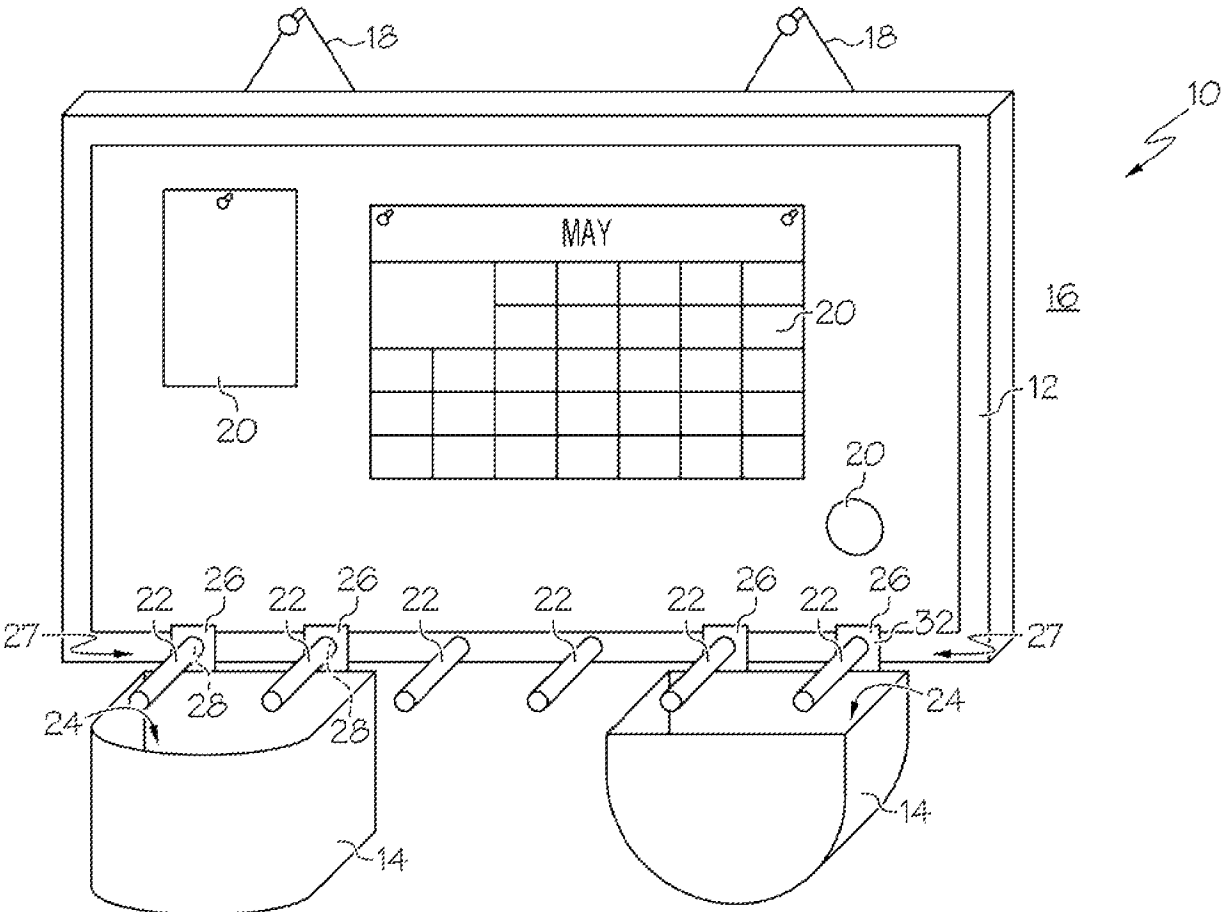
FIG. 3 is a front perspective view of another embodiment of the system of the present invention.

As shown in FIG. 3, more than one storage component 14 can be utilized and coupled to the board 12. Moreover, it should be understood that the storage components 14 can take any of a wide variety of shapes, such as the storage components shown in FIG. 1 or 3, but could also include various school, office and home products, such as notebooks, office supplies, folders, binders, etc. In addition, each storage component 14 may be able to be utilized, in a modular and interchangeable manner, with other boards 12 having the same or similar configuration/spacing of protrusions 22.

Having described the invention in detail and by reference to the various embodiments, it should be understood that modifications and variations thereof are possible without departing from the scope of the claims of the present application.

What is claimed is:

1. A system comprising:

a first component configured to be attached to a vertical surface, said first component including at least a pair of protrusions coupled thereto with a spacing therebetween; and a second component including a pair of hang tags coupled thereto, each hang tag having an opening therethrough with a spacing therebetween, wherein the spacing between said openings of said hang tags generally corresponds to said spacing between said pair of protrusions such that each protrusion is receivable through the opening of an associated one of said hang tags to removably couple said second component to said first component, wherein each hang tag is generally flat and planar and is movable in a direction generally parallel to a plane of the associated hang tag;

wherein each hang tag is repeatedly movable between an extended position wherein said hang tag protrudes generally outwardly from said second component, and a retracted position wherein said hang tag generally does not protrude generally outwardly from said second component, or protrude generally outwardly less than said hang tag is in its extended position; and wherein when each hang tag is in its extended position, the associated opening is configured to receive a protrusion therethrough, and wherein when each hang tag is in its retracted position, the associated opening is not configured to receive a protrusion therethrough.

2. The system of claim 1 wherein said spacing between said pair of protrusions generally corresponds to said spacing between said openings when said hang tags are both in their extended positions.

3. The system of claim 1 wherein said hang tags are independently movable between their extended and retracted position.

4. The system of claim 1 wherein said second component is a storage component defining an inner cavity therein, and wherein each hang tag is positioned externally of said inner cavity when each hang tag is positioned in either said extended position or said retracted position.

5. The system of claim 1 wherein said first component is generally flat and planar, and wherein said second component is a storage component defining an inner cavity for storing items therein.

6. The system of claim 5 wherein said hang tags are generally co-planar in a plane that is generally parallel with said first component.

7. The system of claim 1 wherein said second component is a generally rectangular prism, and wherein both of said hang tags are coupled to a same side of said second component.

8. The system of claim 1 wherein said second component has a generally flat bottom surface such that said second component can be stably positioned on a horizontal surface and used separate and apart from said first component.

9. The system of claim 1 wherein said protrusions are permanently and non-removably coupled to said first component.

10. The system of claim 1 wherein said pair of protrusions are adjacent protrusions with no protrusions positioned therebetween.

11. The system of claim 1 further including a third component including a pair of hang tags coupled thereto, each hang tag of said third component having an opening therethrough with a spacing therebetween, wherein said spacing between said openings of said hang tags of said third component generally corresponds to a spacing between said pair of protrusions such that each hang tag of said third component can receive one of said protrusions therethrough to removably couple said third component to said first component, wherein each hang tag of said third component is generally flat and planar and is movable in a direction generally parallel to a plane of the associated hang tag.

12. The system of claim 1 wherein said first component includes at least four generally aligned protrusions coupled thereto, each protrusion being equally spaced from any adjacent protrusions.

13. The system of claim 1 wherein said first component is a cork board, or a white board, or a black board, or a felt board, or a display board.

14. The system of claim 1 wherein each hang tag receives one of said protrusions such that said first component is removably coupled to said second component.

15. The system of claim 14 wherein said first component is attached to said vertical surface, and wherein said protrusions are generally horizontally aligned.

16. The system of claim 1 wherein said second component defines an inner volume, and wherein each hang tag is positioned entirely externally to, and does not define any of, said inner volume.

17. The system of claim 1 wherein said second component lacks any opening positioned adjacent to each hang tag.

18. The system of claim 1 wherein said second component defines an inner volume, and wherein said second component is configured such that moving any of said hang tags between said extended and refracted positions does not provide or remove any access to said inner volume.

19. A system comprising:

a first component configured to be attached to a vertical surface, said component including at least a pair of protrusions; and a second component including a pair of hang tags coupled thereto, wherein each hang tag is configured to receive an associated protrusion therethrough to removably couple said second component to said first component, wherein each hang tag is movable from an extended position wherein said hang tag protrudes generally outwardly from said second component to a retracted position wherein said hang tag generally does not protrude generally outwardly from said second component, or protrudes generally outwardly less than when said hang tag is in its extended position;

wherein when each hang tag is in its extended position, the associated opening is configured to receive a protrusion therethrough, and wherein when each hang tag is in its retracted position, the associated opening is not configured to receive a protrusion therethrough.

20. A system comprising:

a first component configured to be attached to a vertical surface, said component including at least a pair of protrusions; and a second component including a hang tag assembly, wherein said hang tag assembly is configured to receive said at least a pair of protrusions therethrough to removably couple said second component to said first component, wherein said hang tag assembly is generally flat and is movable in a direction generally parallel to a plane of the hang tag assembly and wherein the hand tag assembly is movable from a first position for receiving said at least a pair of protrusions to a second position that prevents receipt of said at least a pair of protrusions.

21. The system of claim 20 wherein said hang tag assembly includes a first and a second hang tag, wherein said first and second hang tags are each independently moveable in said direction.

22. The system of claim 20 wherein said hang tag assembly includes hang tag with a pair of openings therethrough, each opening being configured to receive an associated protrusion therethrough.

23. The system of claim 20 wherein said hang tag assembly includes a hang tag with an opening therethrough, said opening being configured to receive said pair of protrusions therethrough.

24. A storage component comprising:

a body defining a storage cavity; and a pair of hang tags coupled thereto, each hang tag having an opening formed therethrough to receive a protrusion, wherein each hang tag is generally flat and planar and is movable in a direction generally parallel to a plane of the associated hang tag, and wherein each hang tag is movable from an extended position wherein said opening is accessible to receive said protrusion to a retracted position wherein said opening is blocked by the body of the storage component such that the opening is not accessible to receive said protrusion, and movable from the retracted position to the extended position.

25. The storage component of claim 24 wherein each hang tag is positioned entirely externally to, and does not define any of, said storage cavity.

26. A method comprising:

accessing a first component attached to a vertical surface, said component including at least a pair of protrusions;

accessing a second component including a pair of hang tags coupled thereto, each hang tag having an opening therethrough, wherein each hang tag is generally flat and is movable in a direction generally parallel to a plane of the associated hang tag; and wherein each hang tag is repeatedly movable between an extended position wherein said opening is accessible to receive said protrusion and a retracted position wherein said opening is blocked by the body of the storage component such that the opening is not accessible to receive said protrusion; and removably coupling said second component to said first component by passing each protrusion through an opening of an associated hang tag while the second component is in the extended position.

27. The method of claim 26 further comprising the steps of decoupling said second component from said first component, and moving each hang tag to a refracted position wherein each hang tag generally does not protrude outwardly from said second component, or protrudes generally outwardly less than when said hang tag is in its extended position.

28. A system comprising a component having an inner cavity and a hang tag, said hang tag having an opening therethrough such that a protrusion is receivable through the opening of said hang tag to removably couple said component to another component, wherein said hang tag is generally flat and planar and is movable in a direction generally parallel to a plane of the hang tag, wherein said hang tag is movable from an extended position wherein said hang tag protrudes generally outwardly from said component to a retracted position wherein said hang tag generally does not protrude generally outwardly from said component, or protrudes generally outwardly less than when said hang tag is in its extended position, and movable from the retracted position to the extended position, and wherein said hang tag is positioned externally of said inner cavity when said hang tag is positioned in either said extended position or said retracted position.

29. The system of claim 28 further comprising said another component, wherein said another component is configured to be attached to a vertical surface and includes said protrusion.

30. The system of claim 28 wherein each hang tag is positioned entirely externally to, and does not define any of, said inner volume.

* * * * *

UNITED STATES PATENT AND TRADEMARK OFFICE

CERTIFICATE OF CORRECTION

PATENT NO. : 9,361,812 B2
APPLICATION NO. : 14/226277
DATED : June 7, 2016
INVENTOR(S) : Megan B. Blume It is certified that error appears in the above-identified patent and that said Letters Patent is hereby corrected as shown below:

In the claims

In Claim 20, Column 6, Line 8, reads "wherein said hang tag assembly is configured to receive"

It should read:

-- wherein said hang tag assembly is configured to selectively receive --

Signed and Sealed this
Twenty-sixth Day of July, 2016

Michelle K. Lee

Michelle K. Lee
*Director of the United States Patent and Trademark Office*